United States Patent [19]

Kobayashi et al.

[11] Patent Number: 4,699,673

[45] Date of Patent: Oct. 13, 1987

[54] METHOD OF MANUFACTURING ALUMINUM ALLOY SHEETS EXCELLENT IN HOT FORMABILITY

[75] Inventors: Yasuo Kobayashi; Michihiro Yoda; Hiromi Goto; Yo Takeuchi, all of Susono, Japan

[73] Assignee: Mitsubishi Aluminium Kabushiki Kaisha, Tokyo, Japan

[21] Appl. No.: 748,684

[22] Filed: Jun. 25, 1985

[30] Foreign Application Priority Data

Jun. 25, 1984 [JP] Japan ..... 59-130792

[51] Int. Cl.[4] ..... C22F 1/04

[52] U.S. Cl. ..... 148/11.5 A; 148/12.7 A

[58] Field of Search ..... 148/11.5 A, 12.7 A, 148/2

[56] References Cited

PUBLICATIONS

Aluminum Standards and Data 1984, Eighth Edition, Dec. 1984, pp. 53–58, Aluminum Association, Inc.

Aluminum, vol. III, Fabrication and Finishing, edited by Van Horn, 1967, pp. 326–330, American Society for Metals.

*Primary Examiner*—Richard O. Dean

*Attorney, Agent, or Firm*—Frishauf, Holtz, Goodman & Woodward

[57] ABSTRACT

A method of manufacturing an aluminum alloy sheet excellent in hot formability. A hot rolled plate of an aluminum alloy is cold rolled into a cold rolled sheet with a reduction ratio of at least 20%. The cold rolled sheet thus obtained is subjected to intermediate heat treatment wherein it is heated to a temperature of 420° to 560° C., at a heating rate of at least 2° C. per second while it is heated from 150° to 350° C., and the sheet is then cooled to room temperature, at a cooling rate of at least 1° C. per second while it is cooled from 420° to 150° C. The resulting heat treated sheet is subjected to final cold rolling with a reduction ratio of 15 to 60%.

18 Claims, No Drawings

METHOD OF MANUFACTURING ALUMINUM ALLOY SHEETS EXCELLENT IN HOT FORMABILITY

BACKGROUND OF THE INVENTION

This invention relates to a method of manufacturing aluminum alloy sheets excellent in hot formability, i.e. a property of exhibiting very high ductility and very low deformation resistance in a hot atmosphere enough to enable forming same by blow forming as employed in the forming of sheet plastic.

Heat treatable aluminum alloys in general include Al-Cu alloys, Al-Cu-Mg alloys, Al-Mg-Si alloys, and Al-Zn-Mg-Cu alloys. These aluminum alloys are generally equivalent to aluminum alloys numbered 2000's, 6000's and 7000's according to JIS and AA (Aluminum Association of U.S.A.).

A typical conventional method of manufacturing aluminum alloy sheets from such heat treatable aluminum alloys comprises hot rolling an ingot, which has been homogenized at a temperature of 460° to 560° C., at substantially the same temperature as the homogenizing temperature, into a hot rolled plate having a thickness of 2 to 10 mm (usually 6 mm), cold rolling the hot rolled plate with a reduction ratio of 20% or more into a cold rolled sheet having a thickness of 1 to 5 mm, and further cold rolling the cold rolled sheet with a reduction ratio of 20 to 80% into a final thickness of 0.5 to 3 mm. If required, the first cold rolled sheet may be subjected to intermediate annealing to remove internal stresses or working stresses in the cold rolled sheet to thereby obtain an "0" temper material. The intermediate annealing is conducted under such conditions that the sheet is heated at a temperature of about 413° C. in a manner slowly heating the sheet and then slowly cooling same at a cooling rate of about 28° C./hr while the sheet is cooled from 413° C. to 260° C., as already known from "*Aluminum Standards and Data,*" published by The Aluminum Association (1984), or under similar conditions. The heating temperature and the cooling rate are controlled such that most of the working hardening and the precipitation hardening which would take place before the intermediate annealing can be removed and no further precipitation hardening can take place.

However, cold rolled aluminum alloy sheets thus obtained by the conventional method suffer from coarse crystal grains, that is, the crystal grain size usually shows a range of 100 to 300 μm when it is measured in the direction of cold rolling (The "crystal grain size" hereinafter referred to also means one obtained in the same measuring manner as above). Even if the cold rolled sheets are subjected to final annealing or solution heat treatment in order to recrystallize them, the minimum recrystallized grain size is of the order of 20 μm. An aluminum alloy sheet with such grain size cannot show hot formability as high as that of superplastic aluminum alloys.

SUMMARY OF THE INVENTION

It is the object of the invention to provide a method of manufacturing aluminum alloy sheets from ordinary heat treatable aluminum alloys, which are as excellent in hot formability as superplastic aluminum alloy sheets.

The present invention provides a method of manufacturing an aluminum alloy sheet excellent in hot formability, which comprises the steps of:

(1) hot rolling an ingot of an aluminum alloy into a hot rolled plate;

(2) cold rolling the hot rolled plate with a reduction ratio of at least 20% into a cold rolled sheet;

(3) subjecting the cold rolled sheet to intermediate heat treatment wherein the cold rolled sheet is heated to a temperature of 420° to 560° C. in a manner such that it is rapidly heated at a heating rate of at least 1° C. per second while it is heated from 150° to 350° C., and the sheet is then cooled to room temperature in a manner such that it is rapidly cooled at a cooling rate of at least 1° C. per second while it is cooled from 420° to 150° C., to obtain a heat treated sheet; and (4) subjecting the heated treated sheet to final cold rolling with a reduction ratio of 15 to 60%.

DETAILED DESCRIPTION

The applicants have carried out studies in order to manufacture aluminum alloy sheets having hot formability as excellent as that of superplastic aluminum alloys, and as a result have discovered the following facts:

If (1) a heat treatable aluminum alloy manufactured by the aforementioned conventional method is cold rolled with a reduction ratio of 20% or more, (2) the resulting cold rolled sheet is subjected to high temperature intermediate heat treatment wherein it is heated to a temperature of 420° to 560° C. in such a manner that the sheet is rapidly heated at a heating rate of 1° C. per second or more while it is heated from 150° to 350° C., and then it is cooled to room temperature in such a manner that the sheet is rapidly cooled at cooling rate of 1° C. or more while it is cooled from 420° to 150° C., and (3) the resulting heat treated sheet is subjected to final cold rolling with a reduction ratio of 15 to 60%, the resulting aluminum alloy sheet shows very excellent hot formability as high as that of superplastic aluminum alloys for the following reason: Just after having been subjected to the high temperature intermediate heat treatment, the aluminum alloy sheet has a fairly small average grain size of 50 μm or less. Further, after a long period of aging at room temperature following the high temperature intermediate heat treatment, the aluminum alloy sheet is hardened by precipitation of alloy component elements to such a sufficient degree that the tensile strength is 1.3 times or more as high as that of a fully annealed alloy sheet (classified as "O" temper). Therefore, if the aluminum alloy sheet in such state is subjected to hot forming after the final cold rolling, without recrystallization treatment such as annealing and solution heat treatment for relieving the sheet of working stresses, the resulting hot formed product has a very fine crystal grain size of the order of 10 μm by virtue of recrystallization taking place at the beginning of the hot forming process, thus exhibiting very excellent hot formability as high as that of superplastic aluminum alloys.

It is considered that the aluminum alloy sheet obtained by the method according to the invention shows such excellent hot formability mainly by the following reasons:

(a) A recrystallized structure in general is formed due to formation of nuclei of recrystallization and their growth. The original crystal grain boundaries which exist before the sheet is subjected to the final cold rolling form locations of nuclei of recrystallization. Therefore, the finer the crystal grains before the final cold rolling, the more the locations of nuclei of recrystallization and accordingly the smaller the recrystallized grain size.

(b) If the aluminum alloy sheet is cold rolled after being subjected to the high temperature intermediate heat treatment so that it is in a state where principal alloy component elements precipitate to cause hardening of the aluminum alloy sheet, the resulting working stresses are concentrated on deformed zones extending almost parallel with each other with gaps of 1 to 10 μm therebetween so that large energy is stored in the deformed zones to cause formation of a large number of nuclei of recrytallization. When the sheet is recrystallized during hot forming, a very fine grained structure is produced and stabilized by those nuclei.

The present invention is based upon the recognitions stated above.

The method of the invention comprises the aforestated steps.

The manufacturing conditions according to the invention are specified as previously stated for the following reasons:

(a) Reduction Ratio in Cold Rolling Before High Temperature Intermediate Heat Treatment:

The cold rolling step immediately following the hot rolling step should be carried out with a reduction ratio (thickness reduction ratio) of 20% or more, so as to ensure formation of recrystallized grains having an average grain size of 50 μm or less if measured in the direction of cold rolling, during the following high temperature intermediate heat treatment. If the reduction ratio is less than 20%, there is no formation of recrystallization in the aluminum alloy sheet subjected to the high temperature intermediate heat treatment. Even if recrystallization takes place in the aluminum alloy sheet, the recrystallized grain size can be large in excess of 50 μm. If the reduction ratio is 40% or more, best results can be obtained.

(b) High Temperature Intermediate Heat Treatment:

(i) Heating Rate:

In the high temperature intermediate heat treatment of a heat treatable aluminum alloy, the formation of nuclei of recrystallization and growth thereof take place due to stress energy stored in the alloy during the immediately preceding cold rolling step, while the alloy is being heated from 150° to 350° C. Therefore, if the heating rate, i.e. temperature increasing rate at which the heating of the alloy is carried out within the temperature range from 150° to 350° C. is less than 1° C. per second, the relief of the stress energy takes place so slowly that a lesser number of nuclei of recrystallization take place or some portions of the alloy sheet have no formation of recrystallization. As a consequence, the crystal grain size is too large at the time of completion of the recrystallization, that is, fine crystal grains with sizes less than 50 μm cannot be formed. Therefore, according to the invention, the heating rate for the rapid heating is limited to at least 1° C. per second so as to obtain sufficiently fine crystal grains in the recrystallized structure. Particularly, best results can be obtained at a heating rate of 10° C. per second or more.

(ii) Upper Limit of Heating Temperature:

If the upper limit of the heating temperature is less than 420° C., the recrystallization cannot take place to a sufficient extent, and also the precipitation hardening by principal alloy component elements after cooling cannot be promoted to a satisfactory degree. As a result, the aluminum alloy sheet cannot have tensile strength of the resulting alloy sheet 1.3 times or more as high as that of a fully annealed aluminum alloy sheet, after it has been aged for a long period of time at room temperature. On the other hand, if the upper limit of the heating temperature exceeds 560° C., some portions of the aluminum alloy sheet can melt during heating, or the recrystallized grains grow to an excessive extent over an average grain size of 50 μm. Therefore, the upper limit of the heating temperature has been limited to a range of 420° to 560° C. The best upper limit is within a range of 460° to 530° C.

The upper limit of the heating temperature should be set to an appropriate value depending upon the chemical composition of an aluminum alloy to be processed. For example, in a certain Al-Cu-Mg alloy, the upper limit of heating temperature should be limited to less than 500° C., since the alloy can melt if heated above 500° C.

If the heating rate and upper limit of heating temperature are set to values outside the range of the invention such that the recrystallized grain size exceeds an average value 50 μm, nuclei of recrystallization cannot be formed in a sufficient number in the recrystallized structure at the beginning of hot forming which is carried out after the final cold rolling, making it difficult to form recrystallized grains with an average grain size of the order of 10 μm and accordingly achieve excellent hot formability of the aluminum alloy sheet.

The grain size values given throughout the specification means ones determined by measuring the grain size in the direction of cold rolling since the recrystallized grains are mostly elongated in the cold rolling direction.

(iii) Cooling Rate

The high temperature intermediate heat treatment should be carried out such that, principal component elements such as Cu, Mg, Si, and Zn of the aluminum alloy sheet which participate in precipitation hardening enter into solution, and then such component elements should be cooled to room temperature while all or at least part of them are maintained in solution state during the immediately following rapid cooling process. To this end, the alloy sheet should be heated to a temperature of 420° to 560° C., wherein dissolution of the component elements takes place to a sufficient extent, and then the alloy sheet should be rapidly cooled to room temperature at a cooling rate, i.e. temperature decreasing rate of at least 1° C. per second while it is cooled from 420° to 150° C. In the aluminum alloy sheet, the component elements precipitate and coarsen at a rapid rate, during cooling in the temperature range from 420° to 150° C. Therefore, if the aluminum alloy sheet is cooled from 420° to 150° C. at a cooling rate less than 1° C. per second, most of the precipitated component elements can form coarse precipitates, failing to achieve precipitation hardening to a sufficient degree. Particularly, best results can be obtained if the cooling rate is set to 5° C. per second or more.

Thus, in the high temperature intermediate heat treatment according to the invention, the principal component elements of the aluminum alloy sheet are sufficiently dissolved and then cooled at a sufficient cooling rate, such that the resulting alloy sheet has tensile strength 1.3 times or more as high as that of a fully annealed aluminum alloy of the same chemical composition. If the tensile strength of the resulting aluminum alloy sheet is less than 1.3 times as high as that of a fully annealed aluminum sheet even after long-time aging of the alloy sheet at room temperature following the high temperature intermediate heat treatment, due to low heating temperature, low cooling rate, etc., working stresses cannot be concentrated on the deformed zones after the aluminum alloy sheet is subjected to cold rolling. Therefore, when such aluminum alloy cold rolled sheet is subjected to hot forming, the recrystallized structure cannot have fine grains, thus failing to exhibit desired hot formability.

The dissolution degree of the component elements of the heat treated aluminum alloy sheet can be determined by measuring various physical properties such as resistivity and hardness. Further, the dissolved state of the component elements can be determined by merely measuring the tensile strength of the heat treated aluminum alloy sheet with accuracy sufficient to see if the component elements are in a dissolved state suitable for industrial use, even without the use of complicated measuring equipments and measuring methods.

In the high temperature intermediate heat treatment of the invention, the dissolved principal component elements such as Cu, Mg, Si, and Zn precipitate in the form of very fine precipitates, during the latter half of the cooling process wherein the alloy sheet is cooled at a temperature below 150° C. as well as during aging of the alloy sheet at room temperature immediately following the cooling process. The precipitation hardening by the component elements is completed after aging of the aluminum alloy sheet at room temperature for about thirty days.

Heat treated aluminum alloys in general are classified as "T4", "O", etc. depending upon heat treating conditions under which they have been heat treated. For instance, the class "T4" means a heat treating condition of an aluminum alloy wherein the heat treated sheet is aged for a long time after complete dissolution of principal component elements so that the component elements cause precipitation hardening, and "O" a heat treating condition of an aluminum alloy wherein the alloy sheet is completely annealed so that the alloy sheet contains no fine precipitates that cause precipitation hardening, and accordingly has very low strength. In an ordinary heat treatable aluminum alloy, the ratio in tensile strength between an alloy sheet heat treated under "T4" and one heat treated under "O" is approximately 2.0–2.3. This ratio is almost constant regardless of the chemical composition of the alloy. If an aluminum alloy sheet is aged at room temperature for a long time, e.g. for 30 days or more, as in the method according to the invention, it belongs to the class "T4". Therefore, the degree of dissolution of the principal alloy component elements during the high temperature intermediate heat treatment, and precipitation hardening by the elements can be expressed in terms of the ratio of the tensile strength of the alloy to that of an alloy of the same chemical composition heat treated under the class "O".

(c) Reduction Ratio in Final Cold Rolling

If the reduction ratio is less than 15%, the stored stress energy will be too small to cause forming of a recrystallized structure with sufficiently fine grains at the beginning of the hot forming of the cold rolled sheet, resulting in poor hot formability. On the other hand, if the reduction ratio exceeds 60%, this could result in that not only the cold rolling will be difficult to conduct, but also the aluminum alloy sheet shows appreciable anisotropy in hot forming. Therefore, the reduction ratio has been set within a range from 15 to 60%. If the reduction ratio is within a range from 25 to 40%, best results can be obtained without much difficulty in final cold rolling.

Examples of the method according to the invention will be given hereinbelow.

EXAMPLE 1

Aluminum alloys corresponding to alloy numberes according to JIS and AA which have chemical compositions shown in Table 1 were melted and casted into ingots by an ordinary method. The ingots were homogenized at a temperature of 460° to 540° C., and the homogenized ingots were hot rolled at an initial temperature of 420° to 500° C., to obtain hot rolled plates each having a thickness of 4 to 6 mm. Then, the hot rolled plates were each subjected to the initial cold rolling, high temperature intermediate heat treatment, and final cold rolling according to the invention, under conditions shown in Table 2 into aluminum alloy sheets Nos. 1–6, each having a thickness of 1.2 mm, according to the invention.

TABLE 1

| ALLOY NUMBER | CHEMICAL COMPOSITION (WEIGHT %) | | | | | | | | | |
|---|---|---|---|---|---|---|---|---|---|---|
| | Si | Cu | Mg | Zn | Mn | Cr | V | Zr | Ti | Al AND IMPURITIES |
| 2024 | 0.08 | 4.4 | 1.5 | — | 0.6 | — | — | — | 0.03 | bal. |
| 2219 | 0.08 | 6.2 | — | — | 0.3 | — | 0.1 | 0.15 | 0.08 | bal. |
| 6061 | 0.6 | 0.2 | 1.0 | — | — | 0.2 | — | — | — | bal. |
| 7N01 | 0.08 | — | 1.2 | 4.6 | 0.4 | — | — | 0.15 | 0.03 | bal. |
| 7475 | 0.08 | 1.4 | 2.3 | 5.6 | — | 0.2 | — | — | 0.03 | bal. |
| 7150 | 0.08 | 2.2 | 2.4 | 6.3 | — | — | — | 0.12 | 0.03 | bal. |

TABLE 2

| SPECIMEN | ALLOY NUMBER | REDUCTION RATIO IN INITIAL COLD ROLLING (%) | HIGH TEMPERATURE INTERMEDIATE HEAT TREATMENT | | | REDUCTION RATIO IN FINAL COLD ROLLING (%) |
|---|---|---|---|---|---|---|
| | | | HEATING RATE (°C./sec) | HEATING TEMPERATURE (°C.) | COOLING RATE (°C./sec) | |
| ALUMINUM ALLOY SHEETS ACCORDING TO THE INVENTION | | | | | | |
| 1 | 2024 | 72 | 25 | 490 | 20 | 25 |
| 2 | 2219 | 70 | | 530 | | 30 |
| 3 | 6061 | 65 | | 520 | | 40 |

TABLE 2-continued

| | | | | | | | |
|---|---|---|---|---|---|---|---|
| 4 | 7N01 | 70 | | 460 | | | 30 |
| 5 | 7475 | 72 | | 480 | | | 25 |
| 6 | 7150 | | | 475 | | | |

| SPECIMEN | ALLOY NUMBER | AVERAGE GRAIN SIZE (μm) | PROPERTIES AFTER HIGH TEMPERATURE INTERMEDIATE HEAT TREATMENT: TENSILE STRENGTH OF "T4" ALLOY (A) ($Kgf/mm^2$) | TENSILE STRENGTH OF "O" ALLOY (B) ($Kgf/mm^2$) | A/B | HOT TENSILE PROPERTIES: TEMPERATURE (°C.) | FRACTURE ELONGATION (%) |
|---|---|---|---|---|---|---|---|
| ALUMINUM ALLOY SHEETS ACCORDING TO THE INVENTION | | | | | | | |
| 1 | 2024 | 23 | 34.3 | 19.0 | 1.8 | 490 | 650 |
| 2 | 2219 | 19 | 29.9 | 17.3 | 1.7 | 520 | 430 |
| 3 | 6061 | 23 | 24.0 | 12.1 | 2.0 | 530 | 390 |
| 4 | 7N01 | 25 | 34.7 | 19.8 | 1.8 | 520 | 480 |
| 5 | 7475 | 23 | 42.6 | 22.5 | 1.9 | 520 | 810 |
| 6 | 7150 | 28 | 44.2 | 23.0 | 1.9 | 500 | 620 |

Then, the aluminum alloy sheets Nos. 1–6 according to the invention were subjected to a hot tensile test at temperatures of 490° C., 500° C., 520° C., and 530° C. and at a strain rate of $2.8\times10^{-3}$ per second, to measure the fracture elongation. The measurement results are shown in Table 2. Also shown in Table 2 are properties of the aluminum alloy sheets measured after they were subjected to the high temperature intermediate heat treatment.

From the measurement results shown in Table 2, it will be learned that the aluminum alloy sheets Nos. 1–6 according to the invention show fracture elongation of more than 390%, that is, very excellent hot formability, as compared with an aluminum alloy sheet in the "O" state, manufactured by the conventional method including cold rolling and intermediate annealing, hereinbefore described, shows fracture elongation of 100% at most.

EXAMPLE 2

Hot rolled plates obtained from aluminum alloys corresponding to alloy Nos. 7475, 2024, 6061 according to JIS and AA, prepared in the same manner as in Example 1 were subjected to the initial cold rolling, high temperature intermediate heat treatment, and final cold rolling according to the invention under conditions shown in Table 3, to obtain aluminum alloy sheets Nos. 7–25 according to the invention and comparative aluminum alloy sheets Nos. 1–17, each having a final thickness of 1.2 mm the same as in Example 1.

The comparative aluminum sheets Nos. 1–17 each have at least one manufacturing condition (asterisked in Table 3) falling outside the scope of the invention.

Then, the aluminum alloy sheets Nos. 7–25 according to the invention and the comparative aluminum alloy sheets Nos. 1–17 were subjected to a hot tensile test at temperatures shown in Table 3 and at a strain rate of $2.8\times10^{-3}$ per second, the same as in Example 1. Then, each of the alloy sheets had their fracture elongation tested and measured in the direction of cold rolling as well as in the transverse direction perpendicular to the direction of cold rolling. The measurement results are shown in Table 3. Also shown in Table 3 are properties of the aluminum alloy sheets measured after they were subjected to the high temperature intermediate heat treatment.

From Table 3, it will be learned that the aluminum alloy sheets Nos. 7–25 according to the invention all show fracture elongation of more than 300% when tested and measured in the direction of cold rolling, and also show fracture elongation in the transverse direction not so different from that in the direction of cold rolling, thus exhibiting excellent hot formability. On the other hand, the comparative aluminum alloy sheets Nos. 1–17 each of which has at least one manufacturing condition falling outside the scope of the invention only show fracture elongation of far less than 300% in the direction of cold rolling, except No. 7 which shows very low fracture elongation of far less than 300% in the transverse direction though it shows fracture elongation of more than 300% in the cold rolling direction. That is, the comparative alloy sheets have very large differences between fracture elongation in the cold rolling direction and that in the transverse direction, thus exhibiting very poor hot formability.

TABLE 3

| SPECIMEN | ALLOY NUMBER | REDUCTION RATIO IN INITIAL COLD ROLLING (%) | HIGH TEMPERATURE INTERMEDIATE HEAT TREATMENT: HEATING RATE (°C./sec) | HIGH TEMPERATURE INTERMEDIATE HEAT TREATMENT: HEATING TEMPERATURE (°C.) | HIGH TEMPERATURE INTERMEDIATE HEAT TREATMENT: COOLING RATE (°C./sec) | REDUCTION RATIO IN FINAL COLD ROLLING (%) | PROPERTIES AFTER HIGH TEMPERATURE INTERMEDIATE HEAT TREATMENT: AVERAGE GRAIN SIZE (μm) | PROPERTIES AFTER HIGH TEMPERATURE INTERMEDIATE HEAT TREATMENT: TENSILE STRENGTH OF "T4" ALLOY (A) (Kgf/mm²) | PROPERTIES AFTER HIGH TEMPERATURE INTERMEDIATE HEAT TREATMENT: TENSILE STRENGTH OF "O" ALLOY (B) (Kgf/mm²) | PROPERTIES AFTER HIGH TEMPERATURE INTERMEDIATE HEAT TREATMENT: A/B | HOT TENSILE PROPERTIES: TEMPERATURE (°C.) | HOT TENSILE PROPERTIES: FRACTURE ELONGATION IN COLD ROLLING DIRECTION (%) | HOT TENSILE PROPERTIES: FRACTURE ELONGATION IN TRANSVERSE DIRECTION (%) |
|---|---|---|---|---|---|---|---|---|---|---|---|---|---|
| ALUMINUM ALLOY SHEETS ACCORDING TO THE INVENTION | | | | | | | | | | | | | |
| 7 | 7475 | 22 | 10 | 480 | 20 | 25 | 45 | 43.4 | 22.5 | 1.9 | 520 | 360 | 330 |
| 8 | | | 1.7 | | 40 | | 49 | 46.3 | | 2.1 | | 310 | 270 |
| 9 | | 60 | | | 20 | 33 | 42 | 43.5 | | 1.9 | | 400 | 320 |
| 10 | | 72 | 15 | 430 | 10 | 25 | 35 | 36.6 | | 1.6 | | 330 | 300 |
| 11 | | | 25 | 550 | 20 | 33 | 27 | 43.7 | | 1.9 | | 540 | 340 |
| 12 | | 60 | 10 | 480 | 1.3 | | 28 | 29.7 | | 1.3 | | 340 | 250 |
| 13 | | 72 | 25 | | 20 | 17 | 23 | 42.8 | | 1.9 | | 460 | 440 |
| 14 | | 60 | 10 | | 5 | 55 | 28 | 35.9 | | 1.6 | | 600 | 280 |
| COMPARATIVE ALUMINUM ALLOY SHEETS | | | | | | | | | | | | | |
| 1 | 745 | 18* | | | 20 | 33 | 55 | 42.8 | 22.5 | 1.9 | 520 | 200 | 120 |
| 2 | | 60 | 0.8* | | | | 52 | 42.9 | | 1.9 | | 160 | 120 |
| 3 | | 72 | 20 | 410* | 5 | 25 | 43 | 27.3 | | 1.2 | | 220 | 130 |
| 4 | | 60 | 10 | 565* | 20 | 33 | 35 | 37.0 | | 1.6 | | 90 | 100 |
| 5 | | 60 | 10 | 480 | 0.8* | 33 | 28 | 25.9 | | 1.2 | | 220 | 120 |
| 6 | | | | | 20 | 13* | 23 | 43.2 | | 1.9 | | 260 | 250 |
| 7 | | 50 | | | | 65* | 28 | 43.3 | | 1.9 | | 400 | 160 |
| ALUMINUM ALLOY SHEETS ACCORDING TO THE INVENTION | | | | | | | | | | | | | |
| 15 | 2024 | 25 | 10 | 490 | 20 | 33 | 42 | 34.8 | 19.0 | 1.8 | 490 | 350 | 280 |
| 16 | | 60 | 1.7 | | 30 | 25 | 46 | 35.4 | | 1.9 | | 330 | 290 |
| 17 | | 72 | 15 | 430 | 10 | | 38 | 28.5 | | 1.5 | | 310 | 280 |
| 18 | | 60 | 10 | 490 | 1.5 | 33 | 29 | 26.8 | | 1.4 | | 440 | 320 |
| 19 | | 72 | 25 | | 20 | 17 | 22 | 34.3 | | 1.8 | | 410 | 370 |
| 20 | | 60 | 10 | | 5 | 55 | 27 | 28.4 | | 1.5 | | 480 | 320 |
| COMPARATIVE ALUMINUM ALLOY SHEETS | | | | | | | | | | | | | |
| 8 | 2024 | 18* | | | 20 | 33 | 58 | 33.9 | 19.0 | 1.8 | 490 | 220 | 170 |
| 9 | | 60 | 0.8* | | 30 | 25 | 54 | 35.1 | | 1.8 | | 250 | 190 |
| 10 | | 72 | 10 | 410* | 5 | | 42 | 23.4 | | 1.2 | | 160 | 140 |
| 11 | | 60 | 10 | 490 | 0.5* | 33 | 29 | 24.0 | | 1.2 | | 210 | 140 |
| 12 | | 72 | 25 | | 20 | 13* | 23 | 34.9 | | 1.8 | | 260 | 250 |
| 13 | | 60 | 10 | | 5 | 65* | 27 | 28.4 | | 1.5 | | 420 | 200 |
| ALUMINUM ALLOY SHEETS ACCORD- | | | | | | | | | | | | | |

TABLE 3-continued

| SPECIMEN | ALLOY NUMBER | REDUCTION RATIO IN INITIAL COLD ROLLING (%) | HIGH TEMPERATURE INTERMEDIATE HEAT TREATMENT: HEATING RATE (°C./sec) | HEATING TEMPERATURE (°C.) | COOLING RATE (°C./sec) | REDUCTION RATIO IN FINAL COLD ROLLING (%) | PROPERTIES AFTER HIGH TEMPERATURE INTERMEDIATE HEAT TREATMENT: AVERAGE GRAIN SIZE (μm) | TENSILE STRENGTH OF "T4" ALLOY (A) (Kgf/mm²) | TENSILE STRENGTH OF "O" ALLOY (B) (Kgf/mm²) | A/B | HOT TENSILE PROPERTIES: TEMPERATURE (°C.) | FRACTURE ELONGATION IN COLD ROLLING DIRECTION (%) | FRACTURE ELONGATION IN TRANSVERSE DIRECTION (%) |
|---|---|---|---|---|---|---|---|---|---|---|---|---|---|
| ING TO THE INVENTION | | | | | | | | | | | | | |
| 21 | 6061 | 25 | 3 | 520 | 30 | 25 | 45 | 24.2 | 12.1 | 2.0 | 530 | 340 | 290 |
| 22 | | 50 | 10 | 430 | | | 27 | 17.0 | | 1.4 | | 290 | 270 |
| 23 | | | | 520 | 1.3 | 33 | 22 | 20.2 | | 1.7 | | 330 | 260 |
| 24 | | | | | 30 | 17 | 23 | 24.6 | | 2.0 | | 350 | 330 |
| 25 | | 40 | | | | 55 | 26 | 24.5 | | 2.0 | | 350 | 260 |
| COMPARATIVE ALUMINUM ALLOY SHEETS | | | | | | | | | | | | | |
| 14 | | 18* | 0.8* | | | 33 | 56 | 23.9 | | 2.0 | | 250 | 200 |
| 15 | | 50 | 10 | 410* | 10 | 25 | 23 | 14.8 | | 1.2 | | 180 | 150 |
| 16 | | | | 520 | 30 | 12* | 23 | 24.5 | | 2.0 | | 240 | 210 |
| 17 | | 33 | | | | 65* | 32 | 24.6 | | 2.0 | | 290 | 220 |

(*falls outside the range of the present invention)

As described above, aluminum alloy sheets according to the invention, possess excellent hot formability as high as that of superplastic aluminum alloy sheets, and can be manufactured from ordinary heat treatable aluminum alloys which are conventionally widely used, thereby avoiding difficulties in the melting, casting, and hot rolling of special superplastic aluminum alloys, as well as solving the problem of low quality with conventional heat treatable aluminum alloys for practical use.

What is claimed is:

1. A method of manufacturing an aluminum alloy sheet having excellent hot formability, which comprises the steps of:

(1) hot rolling an ingot of an aluminum alloy into a hot rolled plate;

(2) cold rolling said hot rolled plate with a reduction ratio of at least 20% into a cold rolled sheet;

(3) subjecting said cold rolled sheet to intermediate heat treatment wherein said cold rolled sheet is heated to a temperature of 420° to 560° C. and then rapidly cooling said heated sheet to room temperature; said cold rolled sheet being rapidly heated at a heating rate of at least 1° C. per second while it is heated from 150° to 350° C., and when said heated sheet is being rapidly cooled to room temperature, it is rapidly cooled at a cooling rate of at least 1° C. per second while it is cooled from 420° to 150° C., to obtain a heat treated sheet; and (4) final cold rolling said heat treated sheet with a reduction ratio of 15 to 60%.

2. The method as claimed in claim 1, wherein said heat treated sheet is aged at room temperature, immediately after said intermediate heat treatment.

3. The method as claimed in claim 1, wherein said reduction ratio of said step (2) is at least 40%.

4. The method as claimed in claim 1, wherein said heating rate of said step (3) is at least 10° C. per second.

5. The method as claimed in claim 1, wherein said heating temperature of said step (3) is from 460° to 530° C.

6. The method as claimed in claim 1, wherein said cooling rate of said step (3) is at least 5° C. per second.

7. The method as claimed in claim 1, wherein said reduction ratio of said step (4) is from 25 to 40%.

8. The method as claimed in claim 1, wherein said step (1) comprises hot rolling said ingot at an initial hot rolling temperature of 420° to 500° C.

9. The method as claimed in claim 1, wherein said ingot is homogenized at a temperature of 460° to 540° C., before said ingot is hot rolled in said step (1).

10. The method as claimed in claim 3, wherein said reduction ratio of said step (4) is from 25 to 40%.

11. The method as claimed in claim 10, wherein said heating rate of said step (3) is at least 10° C. per second; and said cooling rate of said step (3) is at least 5° C. per second.

12. The method as claimed in claim 11, wherein said heating temperature of said step (3) is from 460° to 530° C.

13. The method as claimed in claim 12, wherein said step (1) comprises hot rolling said ingot at an initial hot rolling temperature of 420° to 500° C.; and said ingot is homogenized at a temperature of 460° to 540° C., before said ingot is hot rolled in said step (1).

14. The method as claimed in claim 13, wherein said heat treated sheet is aged at room temperature, immediately after said intermediate heat treatment.

15. The method as claimed in claim 2, wherein said step (1) comprises hot rolling said ingot at an initial hot rolling temperature of 420° to 500° C.; and said ingot is homogenized at a temperature of 460° to 540° C., before said ingot is hot rolled in said step (1).

16. The method as claimed in claim 15, wherein said heating temperature of said Step (3) is from 460° to 530° C.

17. The method as claimed in claim 16, wherein said heating rate of said step (3) is at least 10° C. per second; and said cooling rate of said step (3) is at least 5° C. per second.

18. The method as claimed in claim 17, wherein said reduction ratio of said step (4) is from 25 to 40%.

* * * * *